US006540482B2

(12) United States Patent
Irie et al.

(10) Patent No.: US 6,540,482 B2
(45) Date of Patent: Apr. 1, 2003

(54) TURBO-TYPE MACHINES

(75) Inventors: Kouichi Irie, Tsuchiura (JP); Tomoyoshi Okamura, Minori (JP); Sumio Sudo, Chiyoda (JP); Junichi Kurokawa, 4-10-3, Mori, Isogoku, Yokohama-shi, Kanagawa-ken 235-0023 (JP)

(73) Assignees: Hitachi, Ltd., Tokyo (JP); Junichi Kurokawa, Yokohama (JP)

( * ) Notice: Subject to any disclaimer, the term of this patent is extended or adjusted under 35 U.S.C. 154(b) by 0 days.

(21) Appl. No.: 09/811,495

(22) Filed: Mar. 20, 2001

(65) Prior Publication Data

US 2003/0031559 A1 Feb. 13, 2003

(30) Foreign Application Priority Data

Sep. 20, 2000 (JP) ..... 2000-286110

(51) Int. Cl.[7] ..... F01D 1/00

(52) U.S. Cl. ..... 415/221; 415/119; 415/173.1; 415/914

(58) Field of Search ..... 415/119, 220, 415/221, 914, 173.1

(56) References Cited

U.S. PATENT DOCUMENTS 4,212,585 A * 7/1980 Swardent et al. ..... 415/53 R
4,466,772 A * 8/1984 Okapuu et al. ..... 415/172 A
4,767,266 A * 8/1988 Holz et al. ..... 415/172 A
4,961,686 A * 10/1990 Blair et al. ..... 416/223 A X
5,137,419 A * 8/1992 Waterman ..... 41/170.1
5,607,284 A * 3/1997 Byrne et al. ..... 415/58.7
5,707,206 A * 1/1998 Goto et al. ..... 415/173.1
5,762,470 A * 6/1998 Gelmedove et al. ..... 415/57.4
5,785,495 A * 7/1998 Springer et al. ..... 415/221
6,155,778 A * 12/2000 Lee et al. ..... 415/116 X
6,234,747 B1 * 5/2001 Mielke et al. ..... 415/119
6,283,713 B1 * 9/2001 Harvey et al. ..... 416/193 A X

* cited by examiner

*Primary Examiner*—Edward K. Look
*Assistant Examiner*—James M McAleenan
(74) *Attorney, Agent, or Firm*—Antonelli, Terry, Stout & Kraus, LLP

(57) ABSTRACT

A turbo-type machine, comprising a casing 2 storing an impeller within an inside thereof, and a plural number of grooves formed on an inner surface of the casing in a direction of pressure gradient of fluid, wherein the grooves 124 are provided from 80 to 150 pieces around a periphery on the inner surface of the casing, and a total width of the grooves all around the inner surface of the casing is from 30% to 50% of a peripheral length on the inner surface of the casing. Also, the area on cross-section of the groove 124 within an area where the blades exist is made larger than that of the groove outside where the blades exist, or openings 127 are drilled on a bottom surface of the grooves, each penetrating through thickness of the casing, or the groove is made in a two-layer structure in the direction of pressure gradient of fluid. Or, a round portion 135 is formed at a tip of the blade 122, or a fin 136, thereby suppressing the cavitations to generate, as well as obtaining stabilization of the characteristic curve thereof.

12 Claims, 13 Drawing Sheets

TYPICAL HEAD-FLOW RATE CHARACTERISTIC OF TURBO-MACHINE

TURBO-TYPE MACHINES

BACKGROUND OF THE INVENTION

The present invention relates to a turbo-machine, and in particular to a turbo-type hydro machine being able to prevent flow instability from occurring within fluid (in particular, a water including freshwater and seawater), which flows in an inside thereof, by suppressing rotation of an impeller and stalls in rotation thereof due to re-circulation flow at an inlet of the impeller, irrespective of the types and fluid thereof.

In more detail, the turbo-type machine according to the present invention has an impeller of non-voluminous type, and in particular, it relates to a pump or a pump turbine (a turbo-type pump turbine), in which the fluid flowing therein is a liquid (such as, a water including fresh water and seawater). Namely, according to the present invention, it is possible to prevent the flow instability from occurring within the fluid, by suppressing pre-swirl in main flow of the re-circulation at an inlet of the impeller and/or stalls in rotation of the impeller, and further to reduce generation of cavitations in the impeller, which accompanies increases in vibrations and noises therewith, therefore being suitable for a mixed-flow pump, in particular, which is applicable to a re-circulation water pump, etc., to be used as a drainage pump in a city, or used in a thermal power plant or a nuclear power plant, etc.

FIG. 13 shows a typical characteristic curve between head and flow rate in the turbo-machine of the conventional art, including the mixed-flow pump shown in FIG. 14 therein, where the horizontal axis is a parameter indicative of a flow rate, while the vertical axis a parameter indicative of the head. Namely, the head falls down in a reverse relation to increase of the flow rate in a region of low flow rate, however it rises up following the increase of the flow rate during the time when the flow rate lies within a "S" region (i.e., the characteristic of uprising at the right-hand side). And, when the flow rate rises up further, exceeding over the region of uprising at the right-hand side, then the head falls down again. In a case where the turbo-machine is operated at the flow rate with the characteristic curve of uprising at the right-hand side, a mass of the liquid vibrates by itself, i.e., generating a surging phenomenon.

Such the characteristic curve, uprising at the right-hand side on the head-flow rate curve in the conventional turbo-machine mentioned above, is caused since, although the re-circulation comes out at an outer edge on the inlet of the impeller when the flow rate comes to be low in the fluid flowing through the turbo-machine, but at this instance, a flow passage or a channel for the liquid flowing within the turbo-machine is narrowed, thereby generating a swirl in the liquid (see FIG. 14).

For improving the characteristic of such uprising at the right-hand side in the conventional turbo-machine, as is disclosed in, for example "A New Passive Device to Suppress Several Instabilities in Turbomachines by Use of J-Groove" (Turbomachine Association, published Nov. 1, 1998) presented in a Japan-US Science Cooperation Business Seminar held on Nov. 1 to 6, 1998, it is already proposed by Mr. Junichi KUROKAWA, who is an inventor of the resent invention, and is already known, to provide a plural number of grooves in an axial direction of the pump (i.e., the direction of pressure gradient in fluid) on an inner surface of a casing of the mixed-flow pump.

In the turbo-machine according to the conventional art mentioned above, an idea of providing the grooves in the axial direction of the pump (i.e., the direction of pressure gradient in fluid) on the inner surface of the casing is adopted, for improving the characteristic of uprising at the right-hand side in the turbo-machine, however according to the present inventors, it is acknowledged there sometimes occurs a case where the following problems are caused due to the cavitations generated in the casing with such the idea of providing the grooves formed on the inner surface of the casing.

Namely, the cavitations that comes up to the problem is a phenomenon, where a large number of bubbles occur due to evaporation within the liquid when the pressure of the liquid flowing within the pump is decreased down in the vicinity of the saturated vapor pressure, for example, and those bubbles generated flow within the pump, and/or are collapsed accompanying with recovery of the pressure within the pump. And, such the generation of the cavitations gives damages upon wall surfaces of the impeller, as well as the casing, and it may also cause harmful effects, such as, increase in the vibrations and/or noises, and decrease in the performance thereof, as well.

Also, FIG. 15 shows an experimental result of vibration acceleration, as one representative example of the vibrations and/or noises due to influences of the cavitations, wherein the horizontal axis indicates the flow rate without dimension while the vertical axis the vibration acceleration without dimension thereof. In particular, black circles (●) in the figure show a flow rate-vibration acceleration curve in a condition where the pump is high in NPSH, in which no groove is formed on the casing thereof, white circles (○) in a condition where the pump is low in NPSH, in which no groove is formed on the casing thereof, black triangles (▲) in a condition where the pump is high in NPSH, in which the grooves are formed on the casing in the direction of pressure gradient, and white triangles (Δ) in a condition where the pump is low in NPSH, in which the grooves are formed on the casing in the direction of pressure gradient, respectively. Herein, the NPSH means an effective suction head, and it indicates how much higher a total pressure, which the liquid upon a standard surface of the impeller has, than the saturated vapor pressure of that liquid at that temperature. Namely, the lower the NPSH, the nearer to the saturated vapor pressure, i.e., it comes to the condition where the cavitations can easily occur therein.

As shown in the FIG. 15, in the pump in which no groove is formed on the casing thereof, comparing the black circles (●) of high NPSH to the white circles (○) of low NPSH, the white circles are as about 1.3 times large as the black ones, at the maximum in the vibrations thereof between $\phi$=0.6–1.0, but it does not matter in particular. However, with the black triangles (▲) and white triangles (Δ) indicating the characteristic curves of the pumps, in which the grooves are formed on the inner surface of the casing in the direction of pressure gradient (i.e., the axial direction), as is apparent from the figure, when comparing the black triangles of high NPSH to the white triangles of low NPSH, the white triangles of low in the NPSH of the pump comes to be about as 2.1 times large as the black ones, at the maximum in the vibration thereof between $\phi$=0.6–1.0, and there can be sometimes found cases where the vibrations and/or noises are increased extraordinarily.

A reason of this can be explained as below, upon the basis of an observation of the condition in generating the cavitations within the pump, and an analysis of turbulences in the flow within the pump in a case where no such the cavitations occurs.

Namely, with the impeller of a small outer diameter for aiming at small-sizing of the pump, a load upon a blade is large, therefore a pressure difference between a negative pressure surface and a pressure surface of the blade comes to be large, and in a case where the NPSH is low, the cavitations 4 occurs in an aperture or gap 3 between the blades 122 of the impeller and the casing, as shown in FIGS. 16 and 17. However, the FIG. 16 shows a view of the inner surface of the casing, on which the grooves 124 are formed, being expanded schematically, and the FIG. 17 a cross-section view of the blade of the impeller, being cut by a horizontal cross-section perpendicular to a pump axis thereof. The cavitations 4 occurring in this gap 3 develops up to the negative pressure side of the blade 122, and a rear end of the cavitations reaches up to the grooves 124 mentioned above.

While, as shown in FIG. 18, within the groove 124, the flow 51 of the fluid directing from the impeller to an upstream side is opposite to flow 52 of the fluid entering from the upper stream into the impeller, therefore there occurs a region where the flow stands still within the groove 124. Further, if the cavitations 4 reach up to such the region, the cavitations do not flow away from but stays within the groove, and they are collapsed therein. And, due to the collapse of the cavitations, large noises and/or vibrations are brought about within the pump.

BRIEF SUMMARY OF THE INVENTION

The present invention is made, as was mentioned in details thereof in the above, in consideration of the problem, such as the cavitations, which may occur with the provision of the grooves formed on the inner surface of the casing for dissolving the head-flow rate characteristic of uprising at the right-hand side. Namely, an object according to the present invention is to obtain a turbo-machine, having a head-flow rate characteristic of no such the uprising at the right-hand side, at the same time suppressing the increase of the vibrations and/or the noises therein.

For accomplishing the object mentioned above, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein said grooves are provided in plural from 80 to 150 pieces around a periphery on the inner surface of said casing, and further a total width of said grooves all around the inner surface of said casing is set to be from 30% to 50% with respect to a peripheral length on the inner surface of said casing.

According to such the structure of the turbo-type hydro machine, instable flow of fluid at a terminal end of cavitations, which are generated in a gap at the tip of the blades and enter into the grooves, is guided through a large number of grooves mentioned above, so as to be stabilized therewith, therefore it is possible to mitigate the vibrations and/or noises accompanying with collapse of the cavitations.

Also, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, a cross-section area of said grooves within the area where the blades exist are set to be larger than that of said grooves within an area outside where the blades exist. With constructing it in this manner, it is possible to reduce the vibrations and/or noises due to the cavitations caused in the gap at the tips of the blades.

Further, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein said grooves are disposed in unequal distances around a periphery on the inner surface of said casing. With constructing it in this manner, since the grooves mentioned above are, not arranged in uniform at an equal distance in the inner peripheral direction of the casing, but are in unequal distances, therefore fluctuations in pressure caused by a kind of an interference between the impeller rotating and flow passages of the grooves standing still becomes irregular, therefore it is possible to suppress the cavitations to stay within the grooves periodically, thereby reducing the vibrations and/or noises due to the cavitations.

Also, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein one portion of said plural number of grooves are formed to be uniform in a shape of cross-section thereof in an axial direction of said casing, while other portion of said plural number of grooves are formed to be different in the shape of cross-section thereof from that in the area where the blades exist, and said one portion of grooves and said other portion of grooves are disposed alternately.

Also, in the turbo-type machine mentioned above, it is possible to make the area of cross-section of the groove of the above-mentioned other portion larger than that of the grooves of the one portion mentioned above. For example, while the groove of the one portion is made uniform in the shapes of axial direction thereof, the groove of the other portion is made smaller in the width and larger in the depth than those of the above in the area where the blades exist, and they are positioned alternately or one by one, thereby making the flow of fluid in the grooves, not uniform, but rather be different to one another. Namely, the cavitations generated are made different in shapes thereof, thereby mitigating the vibrations and/or noises when the collapse thereof occurs.

Further, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein openings are drilled on said grooves, each penetrating from a bottom surface thereof through thickness of said casing, in a portion near to a front edge of the blade within the area where no blade exist, and further is provided a ring-like chamber on an outer peripheral surface of said casing, wherein said ring-like chamber is conducted to a position in a stream upper than said penetrating openings in said casing. In this manner, the conducting the grooves to the ring-like chamber on the outer periphery of the casing suppresses the stay of the cavitations, thereby suppressing the generation of the cavitations.

Further, according to the present invention, there is provided a turbo-type machine, comprising: a casing for storing an impeller having blades within an inside thereof; a suction inlet, being dipped within fluid to be transferred, together with at least said casing; and a plural number of grooves formed on an inner surface of said casing, connecting between an inlet side of the blades and an area on said inner surface where the blades exist, in a direction of pressure gradient of fluid, wherein, openings are drilled on said grooves, each penetrating from a bottom surface thereof through thickness of said casing, in a portion near to a front edge of the blade within the area where no blade exist. With such the construction, conducting the grooves to a water tank, in which a pump is dipped into, for example, suppresses the stay of the cavitations, thereby suppressing the generation of the cavitations.

Further, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein said grooves is so set in length thereof within said area where the blades exist, that each of the blades of said impeller intersects with at least one piece or more of said grooves on an inner surface of said casing, irrespective of any position of said blade in a peripheral direction. With constructing it in this manner, since each of the grooves always intersects with at least one piece or more of the blades irrespective of any position of the blades, it is possible to make the difference large between the pressure at a terminal end of the groove at the side of the impeller and the pressure at a start end thereof at the side of suction. With this, the flow flowing through the grooves is increased up, thereby suppressing the cavitations to stay within the grooves, and suppressing the increase of the vibrations and/or noises due to the cavitations.

Further, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein each of said grooves is made in a two-layer structure in the direction of said pressure gradient of fluid, whereby reverse flow from said impeller passes through a layer formed on a side deep with respect to the inner surface of said casing, while main flow directing to said impeller passes through a layer formed on a side shallow with respect to the inner surface of said casing. Namely, the grooves are constructed so that no collision occurs between the main flow and the reverse flow within the grooves, thereby suppressing the stay of the cavitations within the grooves.

In addition to the above, according to the present invention, there is provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein a round portion having a radius from 1/4 to 1/2 of thickness of said blade is formed on a ridge defined by a pressure surface and an outer peripheral surface in a direction of thickness thereof, at a tip of each blade of said impeller. Namely, the round portion having the radius from 1/4 to 1/2 of the thickness of blade is provided at the front edge on the side of pressure surface of the blade, thereby suppressing the cavitations to generate from the front edge of the blade.

Also, according to the present invention, there is further provided a turbo-type machine, comprising: a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein a fin is formed at each tip of said blades of said impeller in a peripheral direction thereof, extending in a direction on side of a negative pressure surface of said blade by a width from 1/4 to 1 of thickness of the blade. Namely, the fin having the width from 1/4 to 1 of thickness of the blade is provided at the tip on the negative pressure surface of the blade, thereby not only suppressing leaking flow in the gap at the tip of the blade, but also suppressing the generation of cavitations.

Other feature(s), object(s) and/or advantage(s) of the present invention will be apparent from the following explanation given below by referring to the attached drawings.

DETAILED DESCRIPTION OF THE INVENTION

Hereinafter, embodiments according to the present invention will be fully explained, by referring to the attached drawings.

Figure 19:
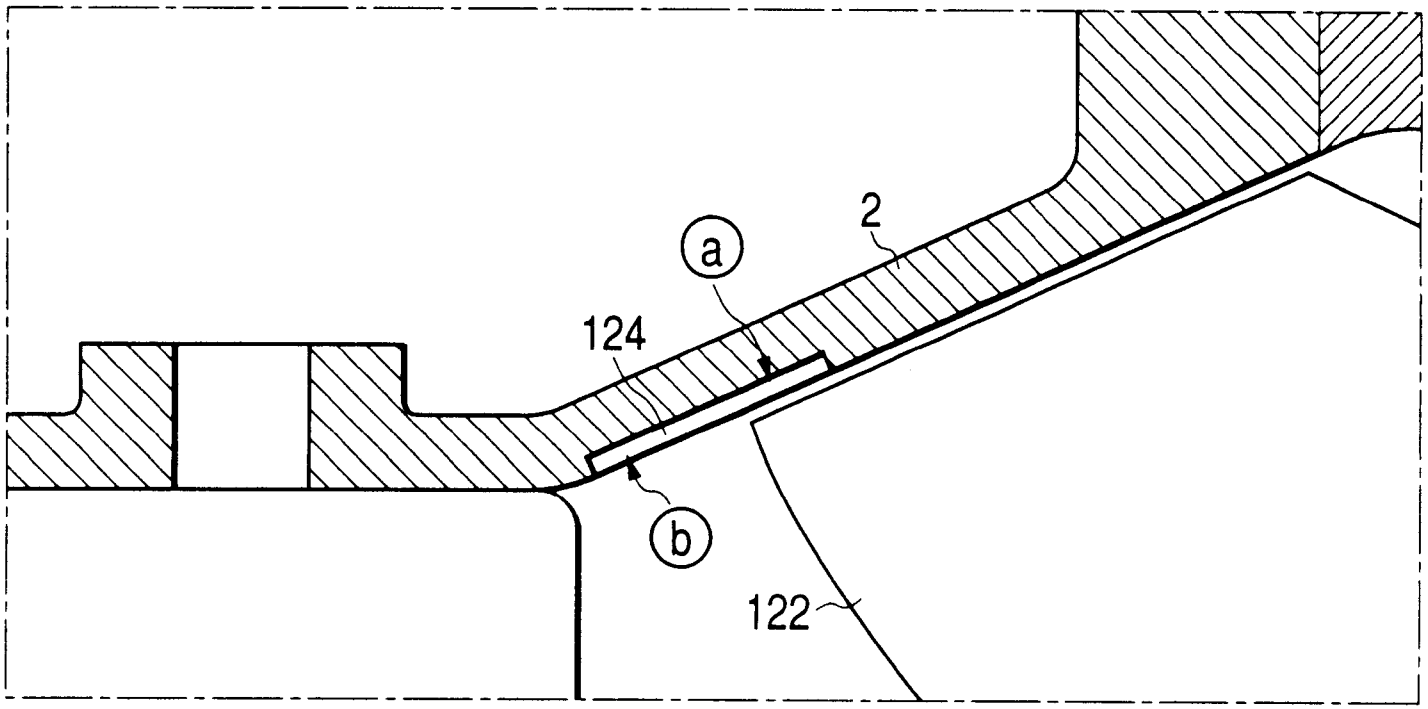
FIG. 19 is an enlarged view of the configuration of the turbo-type hydro machine on a meridian cross-section thereof, into which the present invention is to be applied.

First, FIG. 19 shows an enlarged cross-section view of an ordinary mixed-flow pump, and is an enlarged view of a portion of the mixed-flow pump, which is enclosed by a one-dotted chain line therein. Namely, in a turbo-machine according to the present invention, in which a swirl due to a reverse flow at an inlet of an impeller is suppressed, shallow grooves 124 are formed upon an inner surface of a casing 2, in a direction of pressure gradient of fluid (i.e., the axial direction of the casing), bridging over from a position "a" in a middle of the blade 122 (i.e., the position at terminal end of the groove on a downstream side) up to a position "b" where re-circulation occurs when the flow rate is low (i.e., the position at terminal end of the groove on an upstream side). Then, the fluid being increased in pressure by the blades (i.e., a liquid such as a water, including fresh water and seawater, etc.) flows in reverse direction from the position "a" at the terminal end of the groove on the downstream side to the position "b" at the terminal end of the groove on the upstream side, and spouts at the position where the re-circulation occurs when the flow rate is low, thereby preventing rotation and stalls in rotation of the impeller from being caused due to the re-circulation of the flow.

Figure 1A:
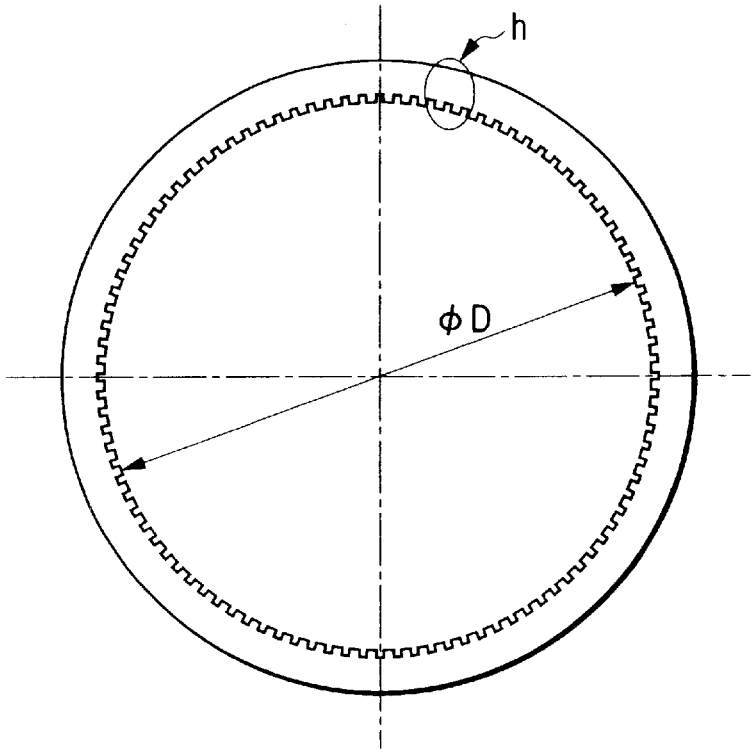
FIGS. 1(*a*) and 1(*b*) are a front cross-section view of a casing and an enlarged view of a portion thereof, for showing the structure of a turbo-type hydro machine, according to a first embodiment of the present invention.
Figure 1B:
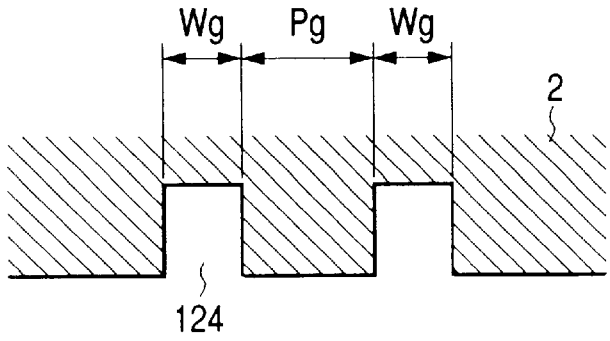

Next, FIGS. 1(*a*) and 1(*b*) show a turbo-type hydro machine, as the turbo-machine, according to a first embodiment of the present invention. And, according to the present invention, in particular as shown in FIG. 1(*b*), a width of each of the grooves formed in a plural number on the inner surface of the casing 2 is set to be nearly equal to the thickness of the above-mentioned blade 122 of the impeller, which is rotatably received within the casing, and a number "n" of pieces of the grooves is indicated by the following equation.

$$n = {}^{\pi \times D}/(Wg+Pg) \qquad \text{(Eq.1)}$$

where, D: an inner diameter of the casing, Wg: a width of the groove, and Pg: a distance between the grooves.

By the way, according to the present embodiment, upon the basis of various experiments made by the inventions and acknowledges of them, the number of pieces of the plural grooves formed on the inner surface of the above-mentioned casing 2 is set to be as several times large as the ordinary number of the grooves in the conventional art, and an instable flow of the fluid at the terminal end portion of the cavitations, which occur in the gap at a tip of the blade and enter into the grooves, is guided to be stabilized, thereby mitigating the vibrations and/or noises accompanying with the collapse of the cavitations. Explaining it in more details, first the width Wg of the groove is set to a value being equal to the thickness "t" of the blade on the side of a shroud, or less than that. For example, in a case where the inner diameter D of the casing is D=250 mm, the number "n" of pieces of the grooves is set to one hundred (100), being as about four (4) times large as the number of pieces (28) in the embodiment according to the conventional art. Further, according to the experiments made by the inventors, it is ascertained that desirous effects can be obtained by setting the number of pieces of the grooves formed on the-inner surface of the above-mentioned casing 2 within around a range from 80 up to 150 pieces.

Also, the width of the groove is set to 3 mm, for example, being narrower than 12 mm in the conventional embodiment, being in inverse proportion to the number of pieces of the above-mentioned grooves, and further, accompanying with this, the distance Pg between the grooves can be obtained from the above-mentioned equation (Eq. 1), such as 4.8 mm. In this instance, the thickness of the blade is about 5 mm. It is also ascertained by the experiments made by the inventors, that a total widths of the grooves all around a periphery thereof is desirous to be 30%–50% of a length of periphery on the inner surface of the casing.

Figure 20:
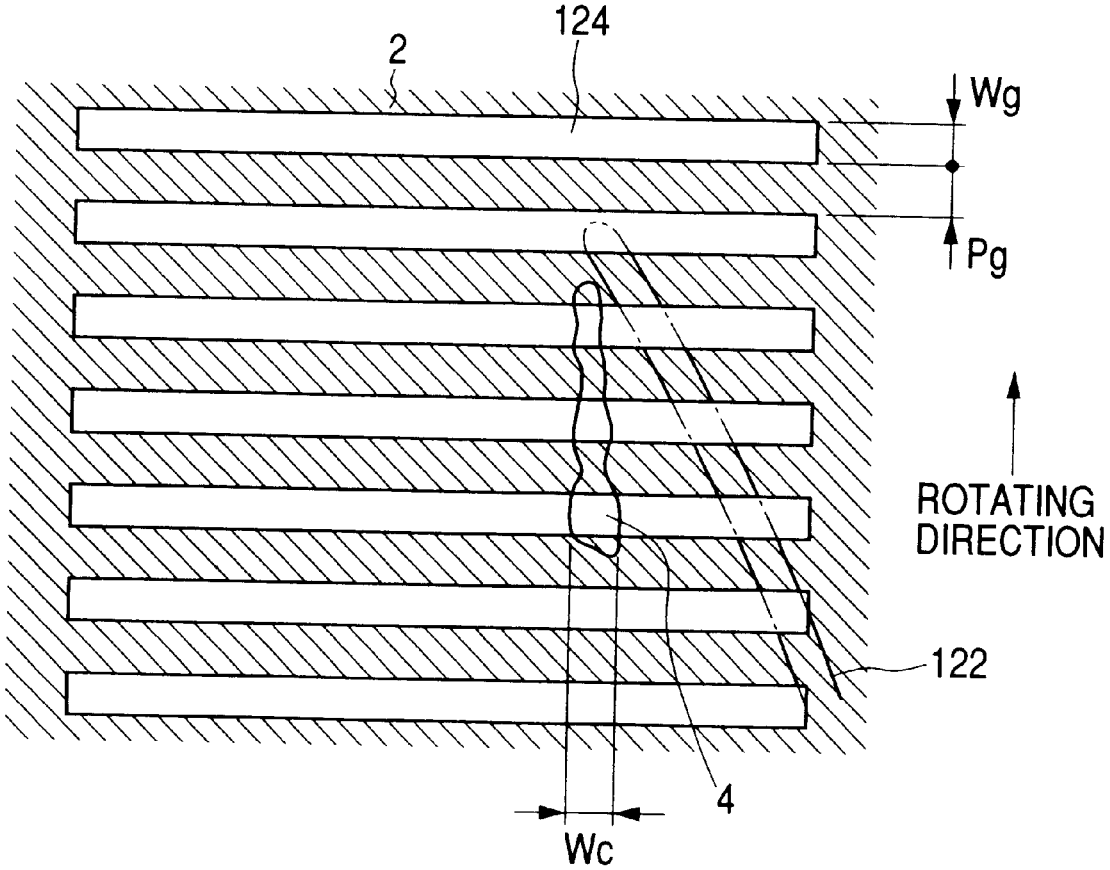
FIG. 20 is an enlarged view of a portion of the grooves formed on the inner surface of the casing, being expanded schematically, for showing the condition of generating cavitations within the mixed-flow pump having the grooves on the inner surface of the casing, as the turbo-type hydro machine, into which the present invention is to be applied.

Further, in the flow passage formed in such the manner, when the cavitations occur in the gap around from 0.3 mm to 0.5 mm at the tip of the blade of the impeller at a low value of the NPSH, for example, as shown in FIG. 20, the width "Wc" of the cavitations 4 generated is nearly equal to the width "Wg" of the groove or greater than that.

By the way, in general, it is already known by the experiments that, in a case where the bubbles due to the cavitations mentioned above are collapsed, the instability in the flow of fluid is reduced if a guiding plate or fin, etc., is provided in the collapsing area or region, thereby strength of the collapse of the cavitations being also reduced at the same time. Accordingly, the flow of the bubbles of cavitations entering into the grooves receives restrictions in the movement thereof by a fixed wall, such as the grooves 124, and is limited in free movement of the flow of bubbles. As a result of this, the flow including the bubbles of cavitations is guided into the flowing the direction of the grooves, by a guiding effect of the sidewalls of a large number of grooves, thereby becoming a stable flow. As a result of this, the vibrations and/or noises resulted from furious collapse of the cavitations can be lessened.

In this manner, for lessoning the vibrations and/or noises due to the cavitations, it is necessary to provide the fixed walls, such as the guide plates or fins, etc., in the vicinity thereof, for the bubbles of cavitations (or, the largeness thereof), and in particular, in the case where the walls are formed by such the grooves as mentioned in the above, it is also necessary for the width "Wg" of said groove to be equal to the width of the cavitations or less than that. It is also desirous that the distance "Pg" between the grooves is about same to the width of the groove mentioned above. Accordingly, in the present embodiment, the width "Wc" of the cavitations occurring in the gap at the tip of the blade is set to be nearly equal to the width "Wg" of the groove.

Further, the mechanism of improvement in the stability of a pump head curve due to the grooves mentioned above is same to that of the conventional art. However, as was mentioned in the above, since the plural grooves are formed on the inner surface of the casing 2 mentioned above in the number of the range from 80 to 150 pieces, approximately, in the turbo-type hydro machine according to the present invention, then the grooves are narrower in the width "Wg" thereof and is larger in the number of pieces than those of the conventional art. With this, an interaction between the flow passing through such the large number of grooves and the main flow is increased up in effect of straitening the flow in the reverse direction, comparing to the conventional technology wherein the grooves are wide in the width and small in the number of pieces thereof, and also the area is increased up where the reverse flow flowing out from the grooves and the main flow entering into the impeller contact and are mixed with, therefore the function due to the said grooves comes to be more certain and the stabilization of the head curve appears more remarkably. However, even if the grooves are greatly increased more than 150 pieces in the number thereof, such the effect does not appears remarkably, but rather this brings the machine to be difficult in the machining thereof, therefore is undesirable.

Figure 2:
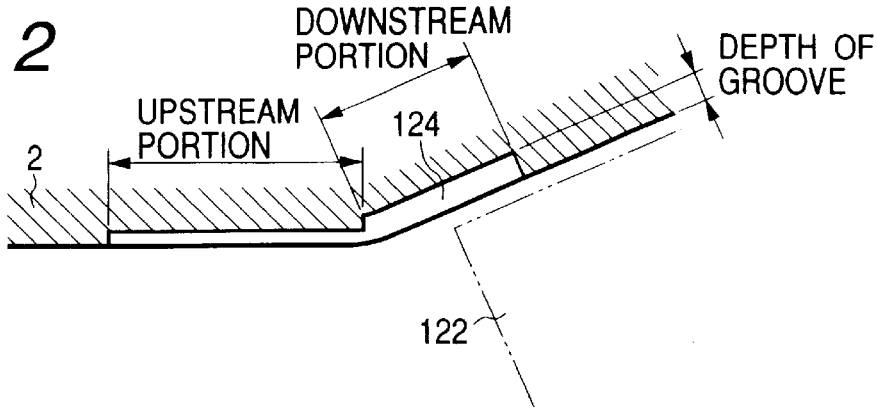
FIG. 2 is an enlarged cross-section view of a portion of a casing on a meridian plane thereof, for showing the structure of a turbo-type hydro machine, according to a second embodiment of the present invention.

Next, FIG. 2 shows an enlarged cross-section view of the turbo-type hydro machine according to a second embodiment of the present invention, in particular a portion of the casing 2, on which the grooves are formed on the inner surface side, as the distinctive feature thereof. In the present embodiment, the depth of the grooves 124 at the downstream portion, in the vicinity of an area where the blades exist, is set to be larger than the depth of the grooves at the upstream portion. In such the construction, an amount of the flow, which is caused by the flow of fluid leaking from a pressure surface of the blade 122 indicated by a two-dotted chain line in the figure directing to the side of negative pressure surface and flows in the reverse direction from the impeller to the upstream in the grooves, comes to be larger than that of the mail flow which tries to flow into the impeller from the upper stream, since the grooves are deep in the depth in the downstream. Further, the width of the grooves 124 is constant, and the number of pieces thereof is appropriately selected within a range from about 20 pieces up to about 30 pieces, similar to the conventional ones, and in particular, 28 pieces of the grooves are provided in the present embodiment, for example.

Figure 18:
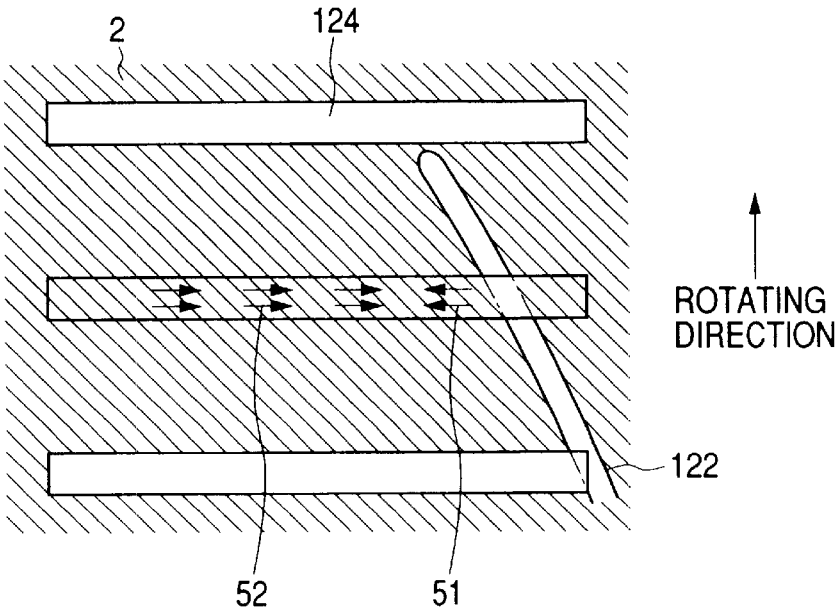
FIG. 18 is a view showing a portion of the grooves on an inner surface of the casing, being expanded schematically, for showing flows in the groove provided on the inner surface of the casing of the turbo-type hydro machine, into which the present invention is to be applied.

Accordingly, no such stagnation area occurs in the flow of fluid due to collision of the main flow 52 and the reverse flow 51 as shown in the FIG. 18, and the reverse flow 51 is dominating in the grooves 124. Then, the cavitations bubbles occurring in the gap between the blade 122 and the casing 2 do not stay there since they flow down to the upstream portion even if entering into the grooves 124, and the pressure within the grooves increases up gradually, while also the collapse of the cavitations bubbles proceeds gradually, thereforeno abrupt collapse thereof will occur. As a result of this, the cavitations 4 occur in the gap, and further the vibrations and/or noises due to the cavitations are reduced down even when they enter into the grooves.

Figure 3:
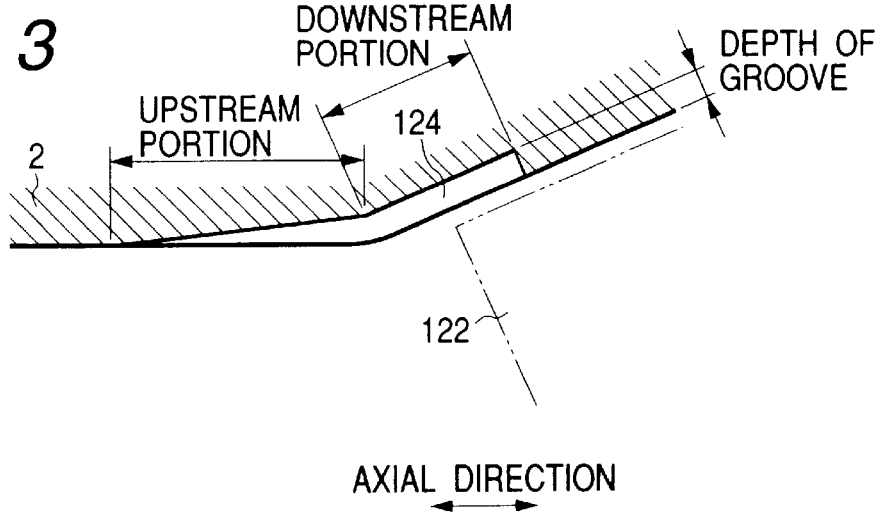
FIG. 3 is an enlarged cross-sectional view of a portion of a casing on a meridian plane thereof, for showing the structure of a turbo-type hydro machine, according to a third embodiment of the present invention.

Continuously, FIG. 3 shows an enlarged cross-section view of the turbo-type hydro machine according to a third embodiment of the present invention, in particular a portion of the casing 2, on which the grooves are formed. As is apparent from this figure, also in the present embodiment, the depth of the grooves in the vicinity of an area where the blades exist (at the downstream portion) is set to be larger than the depth of the grooves at the upstream side, and the grooves are formed, so that the depth thereof becomes continuously shallower as it goes from the downstream potion directing to the upstream portion thereof. Further, the width of the grooves 124 is constant, and the number of pieces thereof is set at 28 in the present embodiment, in the same manner as mentioned above.

The function and/or effect obtained by the grooves 124 mentioned above are/is similar to those/that in the second embodiment mentioned in the above, however in the present embodiment, in addition to the function and/or effect mentioned above, further, as is apparent from the figure, since there is no step-like portion in the upstream portion of the grooves 124 mentioned above, the machining of the said grooves comes to be easier.

Figure 4:
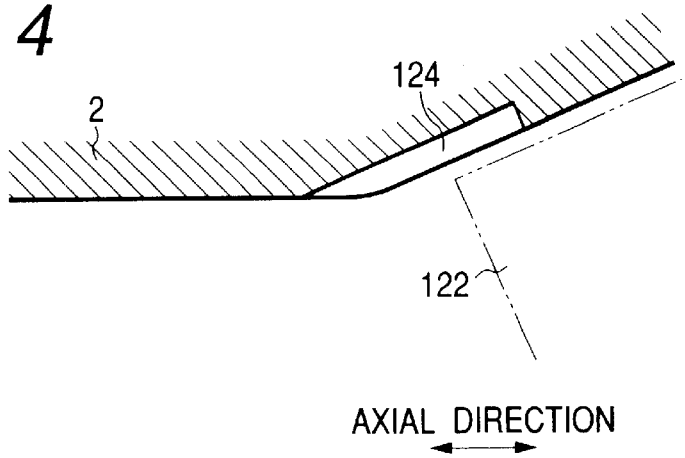
FIG. 4 is an enlarged cross-section view of a portion of a casing on a meridian plane thereof, for showing the structure of a turbo-type hydro machine, according to a fourth embodiment of the present invention.

Further, FIG. 4 shows an enlarged cross-section view of the turbo-type hydro machine according to a fourth embodiment of the present invention, in particular a portion of the casing 2, on which the grooves are formed. Namely, in the present embodiment, in the vicinity of an area where the blades 122 exist, the grooves 124 are provided only in a tapered portion where the flow passage on a meridian plane enlarges the diameter thereof directing to an outlet on the shroud side. In other words, it has such the construction that the grooves in parallel or scaled-down flow passages are shortened in the length thereof, in the construction shown in the FIG. 2 or FIG. 3 mentioned above. The function and/or effect thereof are/is same to those of the third embodiment, however it has a feature that the machining of the grooves becomes much easier. Further, herein, also the number of pieces of the grooves 124 is set at 28 in the present embodiment, in the same manner as mentioned above.

Figure 5:
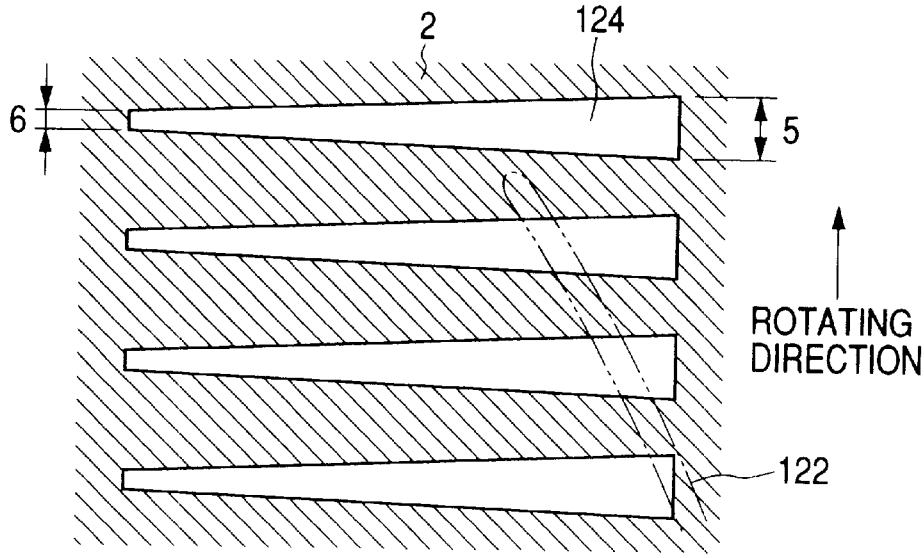
FIG. 5 is an enlarged view of a portion of grooves on an inner surface of a casing, being expanded schematically, for showing the structure of a turbo-type hydro machine, according to a fifth embodiment of the present invention.

Also, FIG. 5 schematically shows a plan view of the turbo-type hydro machine according to a fifth embodiment of the present invention, in particular a portion of an inner peripheral surface of the casing 2, on which the grooves 124 are formed, i.e., the expanded inner surface of the casing on which the grooves 124 are formed. In this embodiment, as is apparent from the figure, the width 5 of the grooves in the area where the blades 122 exist is made larger than the width 6 of the grooves at the upstream portion where no blade exists, and a portion between them is formed in a taper-like, so the groove changes in the width thereof continuously.

However, the depth of the grooves 124 is constant, therefore the cross-section area, in particular the cross-section area of the groove 124 in the area where the blades exist is larger than that of the grooves 124 in the upstream area where no blade exists. Also, herein, the number of pieces the grooves 124 is set at 28 in the present embodiment, in the same manner as mentioned above. Further, the function and/or effect thereof are/is same to those/that of the third embodiment shown in the FIG. 3 mentioned above. Also, in the present embodiment, it is possible to bring the amount of flow to be large, flowing through the grooves 124 formed on the inner peripheral surface of the casing 2 mentioned above, therefore the function of stabilizing the head curve is much larger than that of the other embodiments mentioned in the above.

Figure 6:
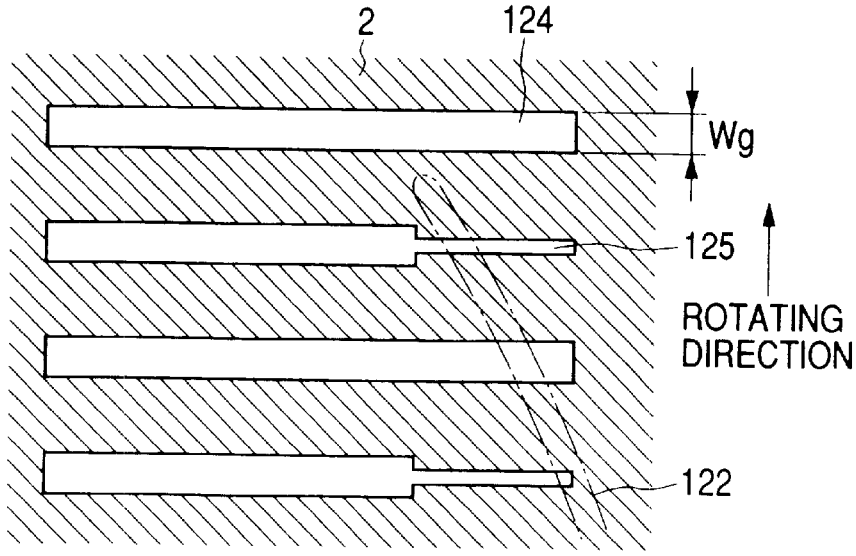
FIG. 6 is an enlarged view of a portion of grooves on an inner surface of a casing, being expanded schematically, for showing the structure of a turbo-type hydro machine, according to a sixth embodiment of the present invention.

Further, FIG. 6 shows the turbo-type hydro machine according to a sixth embodiment of the present invention. In this example, being same as in the FIG. 5 mentioned above, the inner surface of the casing, on which the grooves 124 are formed, is schematically shown under the condition of being expanded. And, in this embodiment, as apparent from the figure, the groove 124 is constant in a form or shape of cross-section thereof in the upstream area where no blade exists, while the groove 125 is narrow in the width Wg in the area where the blades exist (the downstream area) neighboring thereto. Further, the depth of those grooves 124 and 125 is constant. Also, herein, the number of pieces of the grooves 124 is set at 28, in the same manner as mentioned above.

In this manner, narrowing the width Wg of the grooves in the area where the blades exist (the downstream area) brings about an effect of reducing the strength in collapse of the generated cavitations, in the same manner as in the first embodiment shown in the FIG. 1 mentioned above. However, in a case where only such the grooves 125 are provided, being narrow in the width thereof, it is impossible to obtain the reverse flow being sufficient to stabilize the head curve, which can be achieved inherently by such the grooves. Then, the grooves 125 having the narrow width Wg and the grooves 124 having the wide width wg are disposed alternately, thereby obtaining the stabilization of the head curve while also maintaining the reverse flow amount at the same time.

The alternative existence of such the grooves of two (2) kinds in the forms thereof mentioned above (namely, the grooves 124 of wide width Wg and the grooves 125 of narrow width), in the area where the blades exist (the downstream area) on the inner peripheral surface of the casing mentioned above, while increasing the steadiness in behavior of generating the cavitations, brings steady and strong cavitations difficult to occur. In addition, even if the cavitations occur, the generated cavitations are weak in the strength. Accordingly, the strength of the vibrations and/or noises caused due to the collapse of the cavitations bubbles is lightened or reduced.

Figure 7A:
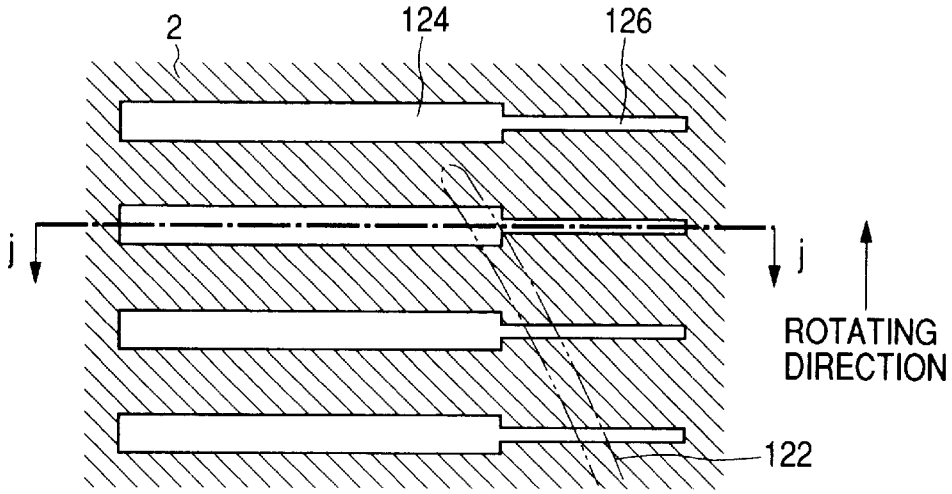
FIGS. 7(*a*) and 7(*b*) are an enlarged cross-section view of a portion of a casing on a meridian plane thereof, and a j-j cross-section view thereof, for showing the structure of a turbo-type hydro machine, according to a seventh embodiment of the present invention.
Figure 7B:
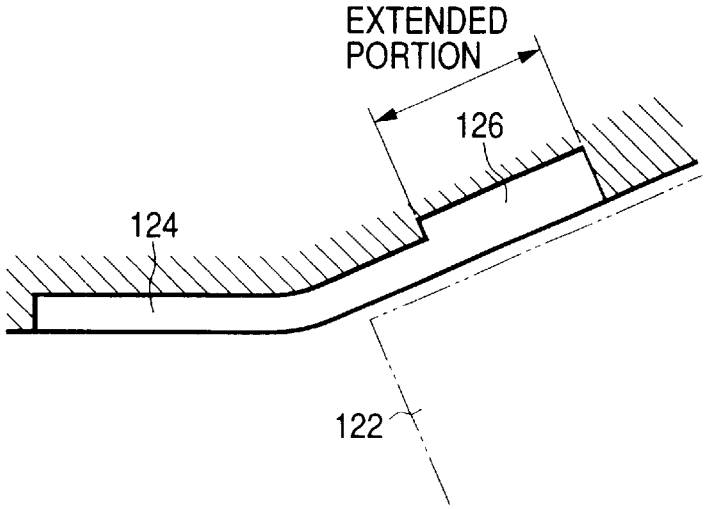

Following to the above, FIGS. 7(*a*) and 7(*b*) show the turbo-type hydro machine according to a seventh embodiment of the present invention. Further, the FIG. 7(*a*) schematically shows the casing, on which the grooves are provided upon the inner peripheral surface thereof, being expanded, while the FIG. 7(*b*) is the cross-section view for showing the structure of the casing, on which the grooves mentioned above are provided.

As apparent from those figures, this embodiment has such the structure as shown by the embodiment 2 in the FIG. 2 mentioned above, i.e., in the structure, in which the grooves are made large in the depth thereof in the area where the blades exist (the downstream portion), there are further provided deep grooves 126 extending therefrom, having a narrow width in the downstream portion. Herein, the number of pieces the grooves 124 is set at 28, in the same manner as mentioned above.

With such the structure, it is possible to let a fluid (water) flow through the grooves 126 mentioned above, which has a high pressure near to that at the outlet within the impeller, then the reverse flow can be generated within the deep grooves 126 with certainty, thereby bringing the cavitations bubbles staying in the grooves in the vicinity of the inlet of the blades 122 to flow out into the upstream portion of the grooves 126, with certainty. Namely, this means, since the length of the deep grooves 126 is large in the direction of length on the meridian plane (namely, on the j-j cross-section in the figure), it is possible to work out a design, so that this deep groove 126 always intersects with any one of the blades 122, in spite of any location thereof in the peripheral direction of the blade 122 of the impeller. And, with this, it is possible to make the reverse flow flowing in the deep grooves 126 and the grooves 124 certain furthermore. As a result of this, in the same manner as in the second embodiment mentioned previously, or in a manner of being more certain and stronger, it is possible to show the function and/or effect, namely, it means that the vibrations and/or noises upon the basis of the collapse of the cavitations can be reduced down, with certainty and greatly.

However, in the first to the seventh embodiments, according to the present invention, shown in the FIGS. 2 through 7 mentioned in the above, the number of pieces of the grooves 124 formed in the area where the blades exist (the downstream area) on the inner peripheral surface of the casing is about 28, being same in the conventional one, however it should not be restricted therewith, according to the present invention, namely in the same manner as shown in the FIG. 1 mentioned above, it is possible to set the number of pieces of the grooves 124 to be as several times large as that of the above, for example, about one hundred (100) pieces, being as roughly four (4) times large as that (within a range from 80 pieces to 150 pieces), and with this, the cavitations can be prevented from the generation thereof, more effectively, or can be suppressed thereby.

Figure 8A:
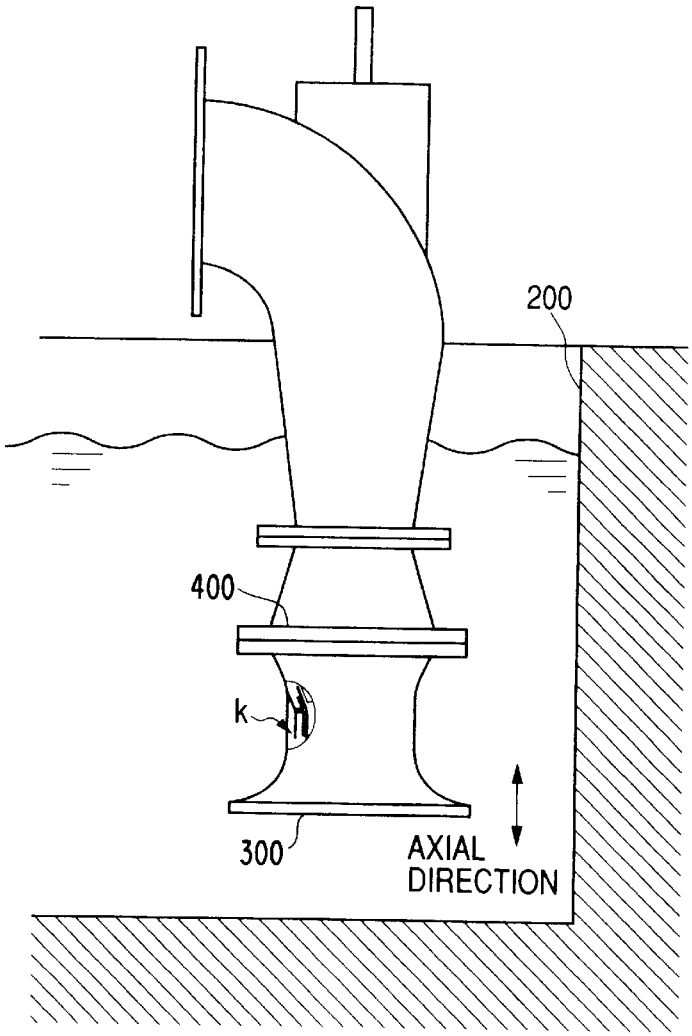
FIGS. 8(*a*) and 8(*b*) are a view of an installation condition and an enlarged view of a portion thereof, for showing the structure of a stand-type pump, adopting the turbo-type hydro machine therein, according to an eighth embodiment of the present invention.
Figure 8B:
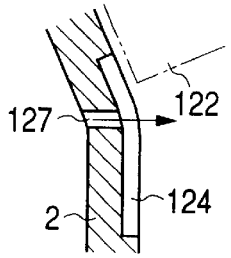

Further, FIGS. 8(*a*) and 8(*b*) show the turbo-type hydro machine according to an eighth embodiment of the present invention, and as shown in the FIG. 8(*a*), it is applied into a stand-type pump, in which a-bell mouth (i.e., a suction inlet) 300 and an impeller portion 400 thereof are installed within a suction water tank 200. In this stand-type pump, as shown in the FIG. 8(*b*), an opening or bore 127 is drilled at a position near to a front edge of the blade 122 where the cavitations bubbles stay, penetrating through the thickness of the casing 2, in each of the grooves 124 provided on the inner peripheral surface of the casing 2 in the axial direction thereof (i.e., the direction of pressure gradient of the fluid), thereby conducting the water within said the grooves 124 with that in the suction water tank 200 through a bottom surface of the groove. Further, the diameter of this opening is so set that the total cross-section area of the openings is equal or less than 1% of the cross-section area at the inlet of the impeller, in the direction perpendicular to the axial direction thereof. Also herein, the number of pieces the grooves 124 is set at 28, in the same manner as mentioned above.

With such the structure, water pressure within the grooves 124 of the casing 2 mentioned above and that within the water tank 200 are kept at almost same pressure through the openings 127 formed on the bottom surface of the grooves penetrating through the thickness of the casing. Accordingly, in a case where the water pressure is so low that the cavitations stay within the grooves 124 mentioned in the above, the pressure of water is higher on the side of the suction water tank 200 in an outside of the pump, and with this, the water flowing within the pump flows from the water tank 200 mentioned above directing to the grooves 124, thereby achieving the function of increasing up the pressure within the grooves 124 mentioned above. Therefore, no cavitations develops in the gaps at the tip of the blades 122, and they are small in the size of bubbles thereof even if being generated, then the vibrations and/or noises caused accompanying with the collapse thereof comes to be small in the strength. Namely, according to the structure of the present embodiment, while the generation of the cavitations is suppressed in the gaps at the tip of the blades, also the vibrations and/or noises generated accompanying with the cavitations are reduced, thereby obtaining the stabilization of the head curve without accompanying the vibrations and/or noises of the cavitations, silently.

Figure 9:
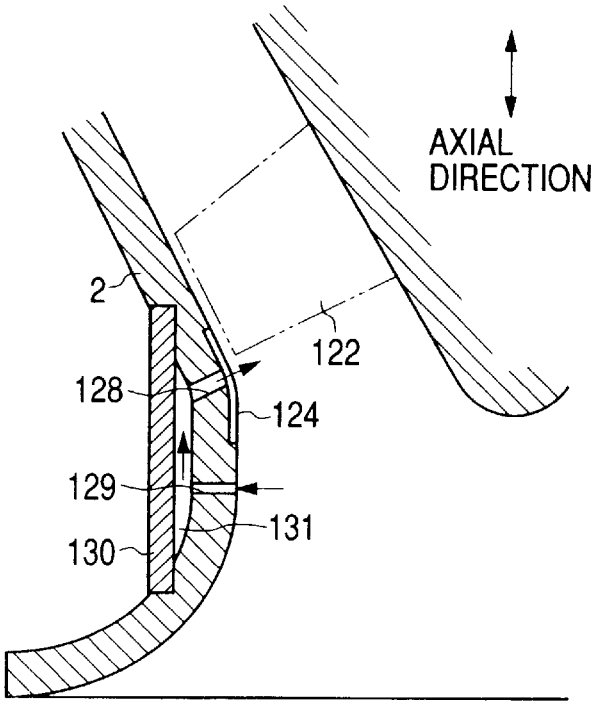
FIG. 9 is a cross-section view on a meridian plane of a casing, for showing the structure of a stand-type pump, adopting the turbo-type hydro machine therein, according to a ninth embodiment of the present invention.

FIG. 9 shows the turbo-type hydro machine according to a ninth embodiment of the present invention. In the present embodiment, the bell mouth and the impeller portion are installed within the suction water tank, in the same manner as in the eighth embodiment mentioned above, i.e., being applied into the stand-type pump. Also, in this stand-type pump, as shown in the figure, an opening or bore 128 is drilled at a position near to the front edge of the blade 122 where the cavitations bubbles stay, penetrating through the thickness of the casing 2, in each of the grooves 124 formed on the inner peripheral surface of the casing 2 in the axial direction thereof (i.e., the direction of pressure gradient of the fluid), and further a second opening or bore 129 is drilled at an upstream position upper than the first opening 128 mentioned above. However, the position to be formed with this second opening 129 is preferable, in particular, on a wall surface of the casing 2 of a throat portion where the flow passage is at the minimum in the cross-section area, in the axial direction of the casing (i.e., the direction of pressure gradient in fluid). Also, on an outside of the casing 2 is provided a cover 130 covering over an outer periphery of the casing 2 in a ring-like manner, thereby forming a chamber 131 of a ring-like shape between this cover 130 and the casing 2. And, as is apparent from the figure, this chamber 131 is constructed, so that it is conducted with a different position on an inner periphery of the casing 2 through the first opening 128 and the second opening 129. Also herein, the number of pieces the grooves 124 is set at 28, in the same manner as mentioned above.

With such the construction, when the cavitations are generated in the gaps at the tip of the blades 122 of the impeller, since the pressure in the vicinity of the grooves 124 is decreased down near to the saturated vapor pressure, the pressure in the vicinity of the first opening 128 mentioned above is lower than the stationary pressure in the vicinity of the second opening 129 mentioned above in the condition thereof. Accordingly, the water as the fluid to be sucked with the pump flows from the second opening 129 mentioned above directing into the first opening 128 (shown by an arrow in the figure). As a result of this, the stationary pressure in the vicinity of the first opening 128 comes to be higher than the pressure near to the saturated vapor pressure, thereby suppressing the development of the cavitations, or making the cavitations small, therefore the vibrations and/or noises accompanying with the collapse thereof also come to be small.

Figure 10:
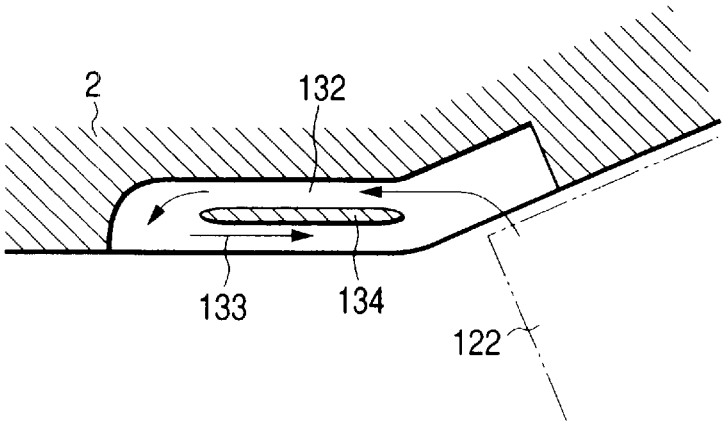
FIG. 10 is an enlarged cross-section view of a portion of a casing on a meridian plane thereof, for showing the structure of a turbo-type hydro machine, according to a tenth embodiment of the present invention.

Further, FIG. 10 shows the turbo-type hydro machine according to the tenth embodiment of the present invention, in particular, the enlarged cross-section view of a portion of the casing 2, on which the plural numbers of grooves are formed on the inner peripheral surface thereof. Each of the grooves, according to the present embodiment, as apparent from the figure, is provided with a thin partition 134 in a central portion in the longitudinal direction thereof, and with this, the groove mentioned above has a two-layer structure, being made up with a first flow passage 132 being large in the distance from the axis of the pump (i.e., at deep side) and a second flow passage 133 being small in the distance from the axis of the pump (i.e., at shallow side). Further, the partition plate 134 is not provided at the both ends of the groove, therefore, this groove has the flow passage of a single layer at the both end portions thereof. Also herein, the number of pieces the grooves 124 is set at 28, in the same manner as mentioned above.

With such the structure of the casing 2 having the groove of the two-layer structure made up with the first flow passage 132 and the second flow passage 133, when the operating point of the pump enters into an area of low flow rate, the reverse flow occurs in the vicinity of the front edge of the blade 2 on the side of the shroud. This reverse flow moves into a direction where the diameter is large due to the centrifugal force, namely as shown by arrows in the figure, and it reaches to the upstream side through the first flow passage 132 of the groove mentioned above. While, the main flow flowing from a suction inlet of the pump flows into the second flow passage 133 having the small diameter. In this manner, with such the two-layer structure formed on the inner peripheral surface of the casing 2, comprising the first flow passage 132 and the second flow passage 133, the main flow and the reverse flow are separated by the partition wall 134 mentioned above, while at the same time the main flow reaching to an outlet end of the grooves is guided by the reverse flow mentioned above there, to flow into the first flow passage 132, thereby forming the re-circulation. In this manner, within the grooves of the two-layer structure mentioned above, the reverse flow and the main flow are escaped from the collision upon each other, and there occurs no area where the cavitations stay. As a result of this, the positions where the cavitations collapse or break down are scattered or dispersed, and also the vibrations and/or noises accompanying with the collapse thereof is reduced.

Figure 11:
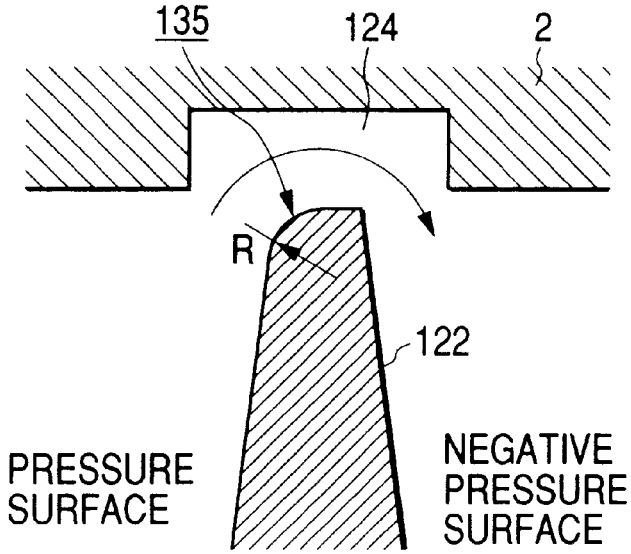
FIG. 11 is a cross-section view along g-g line in the FIG. 16, for showing the structure of a turbo-type hydro machine, according to an eleventh embodiment of the present invention.
Figure 12:
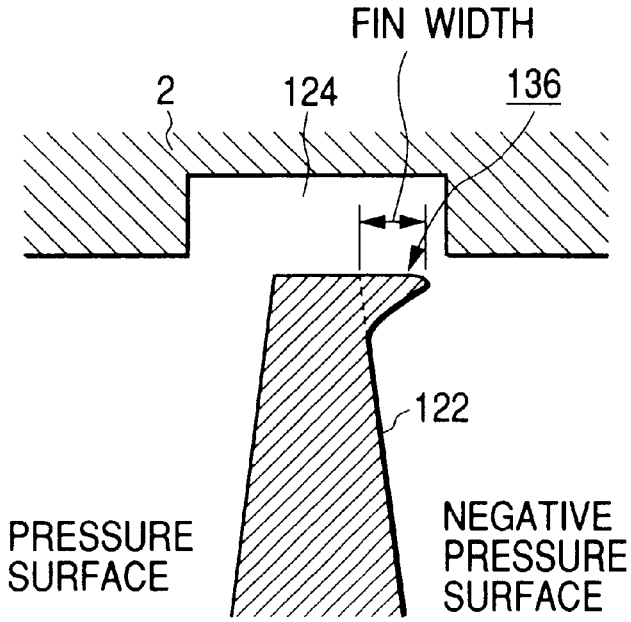
FIG. 12 is a cross-section view along g-g line in the FIG. 16, for showing the structure of a turbo-type hydro machine, according to a twelfth embodiment of the present invention.
Figure 13:
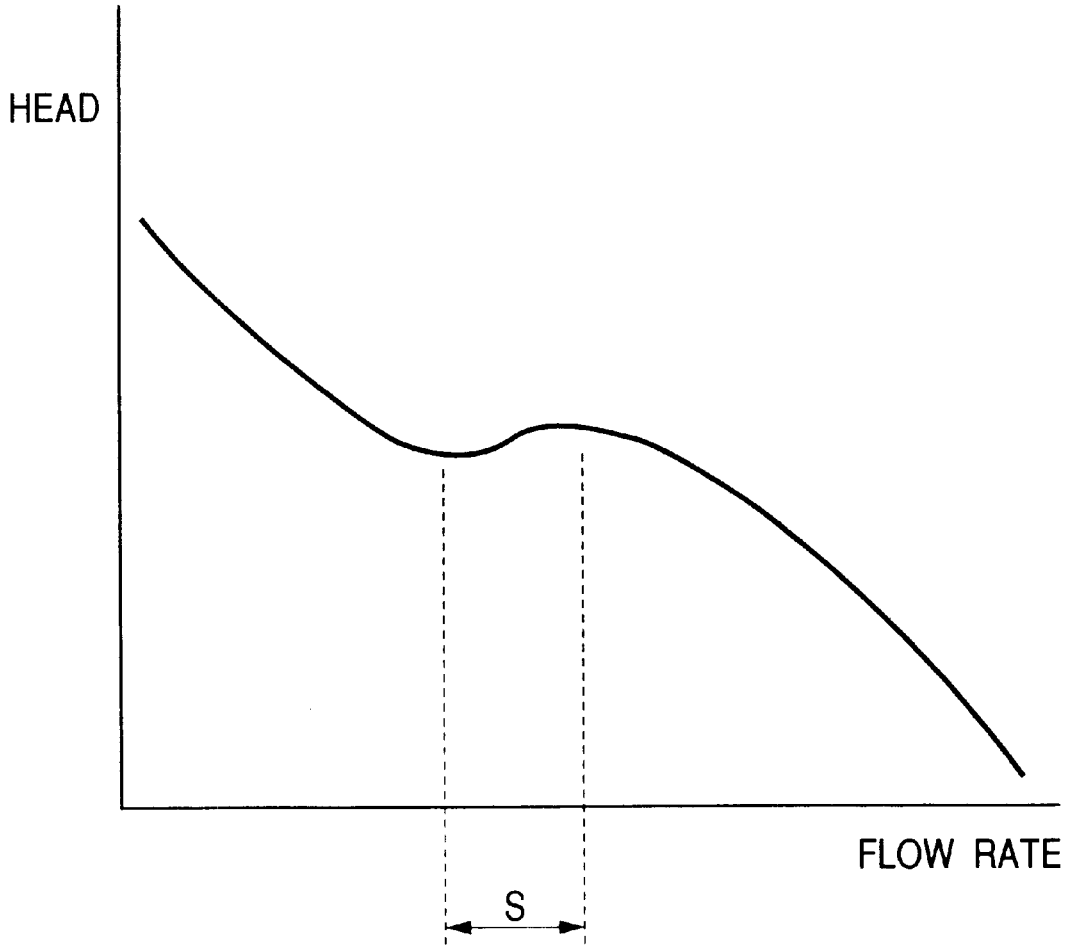
FIG. 13 PRIOR ART
FIG. 13 is a graph for showing a typical head-flow rate characteristic curve of the turbo-machine according to the conventional art.
Figure 14:
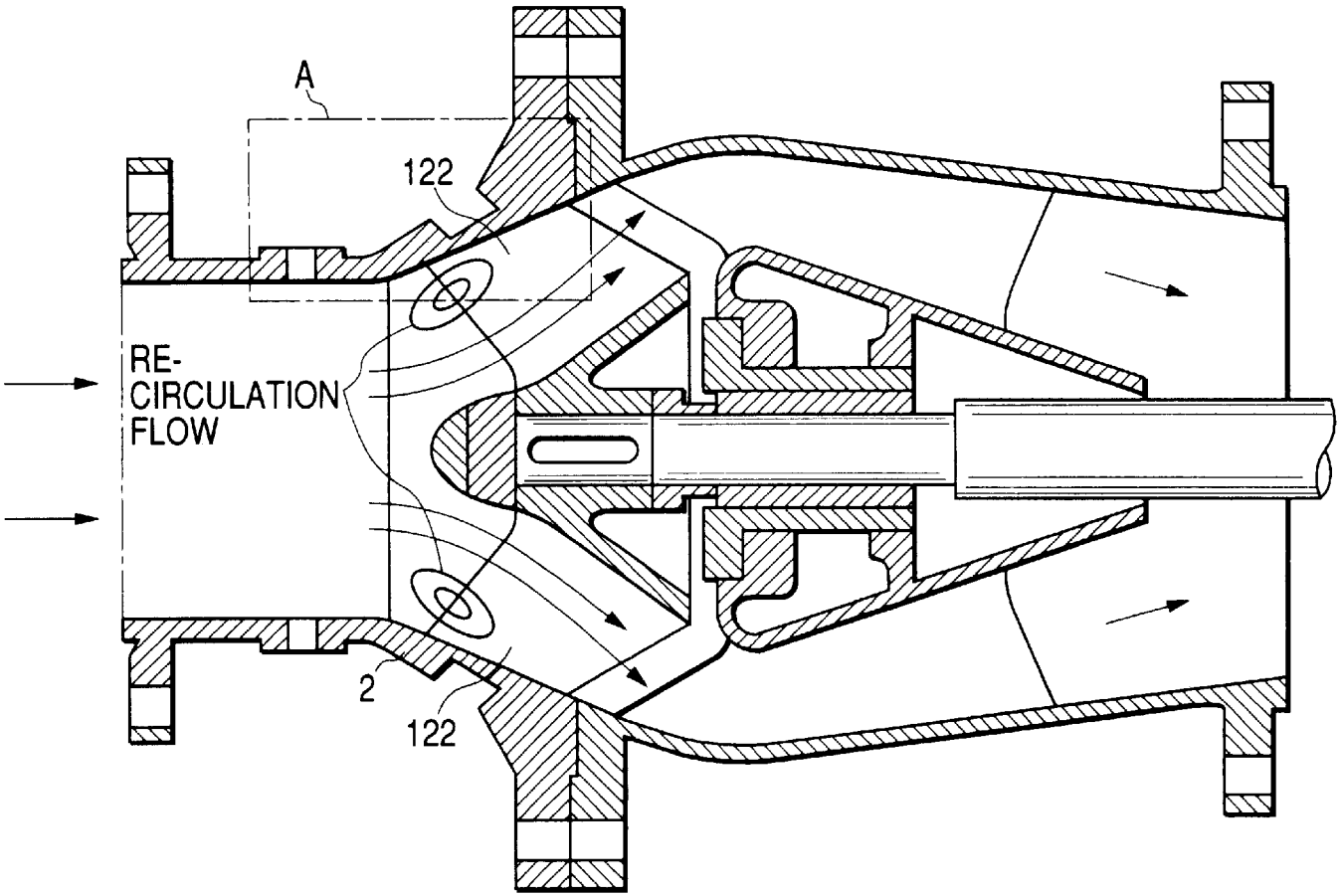
FIG. 14 PRIOR ART
FIG. 14 is a cross-section view of the mixed-flow pump, as a typical example of the conventional art.
Figure 15:
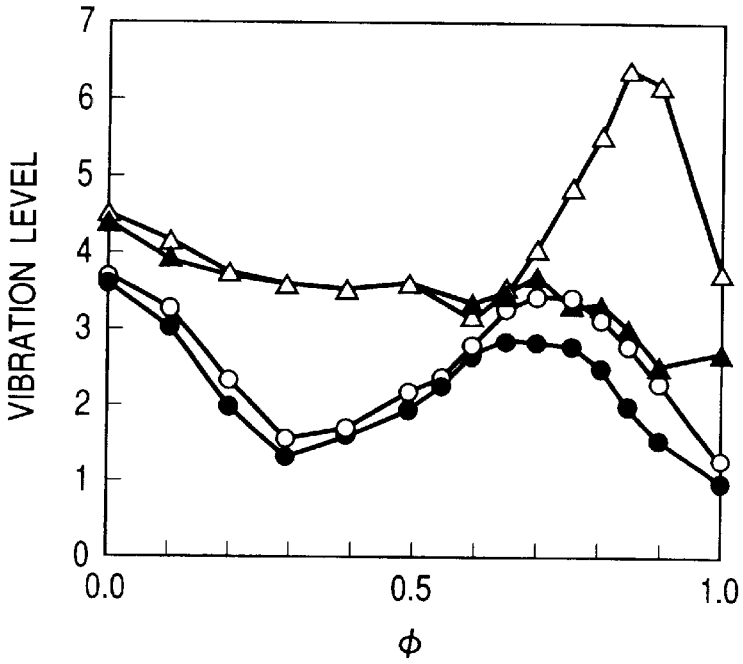
FIG. 15 is a graph for showing vibration acceleration-flow rate characteristics when the NPSH is high and low, in comparison thereof, in the mixed-flow pump having grooves formed on the inner surface of the casing and the mixed-flow pump having no groove on the inner surface thereof, as the turbo-type hydro machine.

FIGS. 11 and 12 attached show an eleventh embodiment and a twelfth embodiment according to the present invention. However, the embodiments mentioned in the above mainly relate to the number of pieces of the grooves and the form thereof, but the present embodiments shown in the FIGS. 11 and 12 relate to a shape of the tip on the blade of the impeller.

Figure 16:
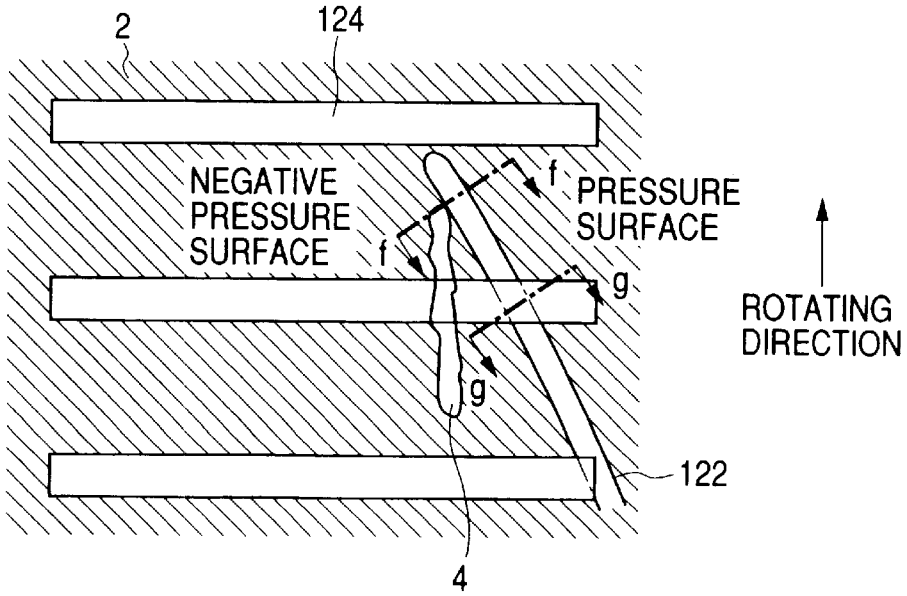
FIG. 16 is a view showing a portion of the grooves on an inner surface of the casing, being enlarged and expanded schematically, for showing the condition of generating cavitations in the mixed-flow pump having the grooves formed on the inner surface of the casing thereof, as the turbo-type hydro machine, into which the present invention is to be applied.
Figure 17:
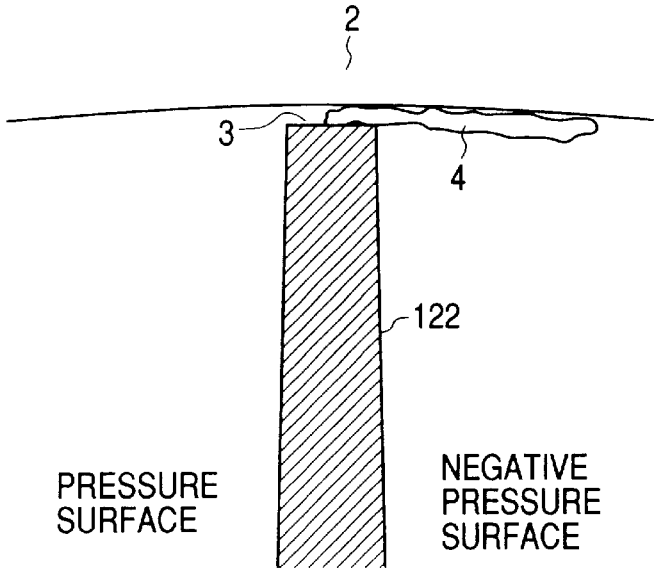
FIG. 17 is a cross-section view along f-f line in the FIG. 16, for showing the condition of generating cavitations in the mixed-flow pump having the grooves formed on the inner surface of the casing thereof, as the turbo-type hydro machine, into which the present invention is to be applied.

First, the FIG. 11 shows the g-g cross-section in the FIG. 16 mentioned above, schematically showing the inner surface of the casing being expanded, on which the grooves 124 are provided. And, according to the present invention, the side of pressure surface at the tip of the blade 122 of the impeller, not defines a sharp edge (about right angle) with respect to an outer peripheral surface like the blade of the conventional art, but shapes a round form 135 having a radius R from 1/4 to 1/2 of the thickness of the blade. With such the round form, no sharp ridge line is defined by the pressure surface and the outer peripheral surface, at the tip of the blade 122. Accordingly, in the gap at the tip of the blade 122, the flow of fluid leaking from the side of the above pressure surface to the side of the negative pressure surface is not exfoliated nor separated at the edge at the tip of the blade 122 mentioned above. As a result of this, there occurs no low-pressure portion on the outer peripheral portion of the blade 122, which is caused by the exfoliation phenomenon mentioned above, therefore the generation of the cavitations is suppressed within the fluid, or the bubbles of the cavitations generated come to be small in the size, therefore also the vibrations and/or noises accompanying therewith come to be small.

Also, FIG. 12 shows g-g cross-section in the FIG. 16, in the same manner as in the FIG. 11. And, in this twelfth embodiment of the present invention, on the side of the negative pressure surface on the outer peripheral portion at the tip of the blade 122 of the impeller is provided a fin 136 having the width from 1/4 to 1 of the blade thickness over the total length (periphery) of the blade 122, or bridging over from the front edge to the central portion of the blade in the peripheral direction thereof. The cross-sectional shape of this fin 136, as is apparent from the figure, has an outer periphery portion forming a surface extending to the outer periphery of the blade 122, while the thickness of the fin 136 is uniform from the tip to the base thereof, or is large at the base and is changed (i.e., is decreased) continuously in the thickness between them.

With the structure of the blade 122 having such the fin 136, the length of the space defined between the outer peripheral portion (surface) of the blade 122 and the casing 2 at the stationary side comes to be longer by the length of the fin 136 mentioned above. And, the flow rate flowing in this gap is in proportional to the pressure difference between the outlet and the inlet of the gap defined, or the square root thereof, on the other hand it is in inverse proportional to the length of the space. Accordingly, with such the structure, the fluid flowing in the gap at the tip of the blade 122 is decreased down in the velocity thereof, and the decrease in the stationary pressure within the said gap also comes to be small. With this, the generation of the cavitations bubbles comes to be small in the gap, and also the vibrations and/or noises accompanying with the cavitations bubbles come to be small.

As was fully mentioned in the above, according to the various embodiments mentioned above of the present invention, with the turbo-type machine having such the construction, that the characteristic curve of the head-flow rate uprising at the right-hand side is removed by means of the grooves, being provided in plural number on the inner peripheral surface of the casing, wherein the cavitations, generated in the gap at the tip of blade accompanying with the above-mentioned grooves provided in plural number thereof, is suppressed to stay within the grooves, or the generation of cavitations itself is suppressed within the gap, therefore it is possible to achieve a superior effect of reducing the vibrations and/or noises which occur in the turbo-type machine, accompanying with the collapse of the cavitations bubbles.

In this manner, according to the present invention, there can be achieve an effect of obtaining the turbo-machine, having the head-flow rate curve without such the characteristic of uprising at the right-hand side, and suppressing the increase in the vibrations and/or noises, as well.

What is claimed is:

1. A turbo-type machine, comprising:

casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, said grooves are provided in plural from 80 to 150 pieces around a periphery on the inner surface of said casing, and further a total width of said grooves all around the inner surface of said casing is set to be from 30% to 50% with respect to a peripheral length on the inner surface of said casing.

2. A turbo-type machine as defined in claim 1, wherein said grooves are so set in length thereof within said area where the blades exist, that each of the blades of said impeller intersect with at least one piece or more of said grooves on an inner surface of said casing, irrespective of any position of said blade in a peripheral direction.

3. A turbo-type machine as defined in claim 1, each of said grooves is made in a two-layer structure in the direction of said pressure gradient of fluid, whereby reverse flow from said impeller passes through a layer formed on a side deep with respect to the inner surface of said casing, while main flow directing to said impeller passes through a layer formed on a side shallow with respect to the inner surface of said casing.

4. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, a cross-section area of said grooves within the area where the blades exist is set to be larger than that of said grooves within an area outside where the blades exist, and a length of said grooves in the area outside where the blades exist is longer than that of said grooves within the area where the blades exist.

5. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, said grooves are disposed at unequal distances in a circumferential direction around a periphery on the inner surface of said casing.

6. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, a portion of said plural number of grooves are formed to be uniform in a shape of cross-section thereof in an axial direction of said casing, while other portion of said plural number of grooves are formed to be different in the shape of cross-section thereof from that in the area where the blades exist, and said portion of grooves and said other portion of grooves are disposed alternately.

7. A turbo-type machine as defined in claim 6, wherein the cross-section area of said other portion of grooves in said area where the blades exist is set to be smaller than that of said portion of grooves.

8. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, openings are drilled on said grooves, each penetrating from a bottom surface thereof through thickness of said casing, in a portion near to a front edge of the blade within the area where no blade exist, and further is provided a ring-like chamber on an outer peripheral surface of said casing, wherein said ring-like chamber is conducted to a position in a stream upper than said penetrating openings in said casing.

9. A turbo-type machine, comprising:

a casing for storing an impeller having blades within an inside thereof;

a suction inlet, being dipped within fluid to be transferred, together with at least said casing; and a plural number of grooves formed on an inner surface of said casing, connecting between an inlet side of the blades and an area on said inner surface where the blades exist, in a direction of pressure gradient of fluid, wherein, openings are drilled on said grooves, each penetrating from a bottom surface thereof through thickness of said casing, in a portion near to a front edge of the blade within the area where no blade exist.

10. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, an edge portion of a tip of each of said blades, said edge portion being defined by a pressure surface and an outer peripheral surface in a direction of thickness thereof, has a round form having a radius from 1/4 to 1/2 of a thickness of said blade.

11. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, a fin is formed at each tip of said blades of said impeller in a peripheral direction thereof, extending in a direction on side of a negative pressure surface of said blade, a ratio of a width of said fin to a thickness of the blade being in a range of 1/4:1 to 1:1.

12. A turbo-type machine, comprising:

a casing for storing an impeller having blades within an inside thereof; and a plural number of grooves formed on an inner surface of said casing, connecting between an inlet side of the blades and an area on said inner surface where the blades exist, in a direction of pressure gradient of fluid, wherein, a cross-section area of said grooves within the area where the blades exist is set to be smaller than that of said grooves within an area outside where the blades exist, and a depth of said grooves within the area where the blades exist is deeper than that of said grooves in the area outside where the blades exist.

* * * * *